US009803641B2

(12) United States Patent
Yamashita et al.

(10) Patent No.: US 9,803,641 B2
(45) Date of Patent: Oct. 31, 2017

(54) METHOD FOR MANUFACTURING ANTI-ROTATION RING OF SCROLL TYPE COMPRESSOR AND ANTI-ROTATION MECHANISM OF THE SCROLL TYPE COMPRESSOR

(71) Applicant: KABUSHIKI KAISHA TOYOTA JIDOSHOKKI, Kariya-shi, Aichi-ken (JP)

(72) Inventors: Takuro Yamashita, Aichi-ken (JP); Ken Suitou, Aichi-ken (JP); Hiroyuki Gennami, Aichi-ken (JP)

(73) Assignee: KABUSHIKI KAISHA TOYOTA JIDOSHOKKI, Kariya-shi, Aichi (JP)

( * ) Notice: Subject to any disclaimer, the term of this patent is extended or adjusted under 35 U.S.C. 154(b) by 545 days.

(21) Appl. No.: 14/298,077

(22) Filed: Jun. 6, 2014

(65) Prior Publication Data

US 2014/0369819 A1 Dec. 18, 2014

(30) Foreign Application Priority Data

Jun. 12, 2013 (JP) ..... 2013-123849

(51) Int. Cl.
*F03C 2/00* (2006.01)
*F03C 4/00* (2006.01)
(Continued)

(52) U.S. Cl.
CPC ..... *F04C 27/00* (2013.01); *F01C 17/063* (2013.01); *F01C 17/066* (2013.01);
(Continued)

(58) Field of Classification Search
CPC F04C 18/0215; F04C 23/008; F04C 2230/60; F04C 2230/20; F04C 27/00; F01C 17/066; F01C 17/063
(Continued)

(56) References Cited

U.S. PATENT DOCUMENTS 5,807,089 A * 9/1998 Tsumagari ..... F01C 17/066 418/55.3
6,339,948 B1 1/2002 Suzumura
(Continued)

FOREIGN PATENT DOCUMENTS

DE 19503321 A1 1/1996
EP 1950419 A1 7/2008
(Continued)

OTHER PUBLICATIONS

Japanese Office Action issued in Japanese Patent Application No. 2013-123849 issued on Jun. 28, 2016.
(Continued)

*Primary Examiner* — Theresa Trieu
(74) *Attorney, Agent, or Firm* — Sughrue Mion, PLLC

(57) ABSTRACT

In a method for manufacturing an anti-rotation ring of a scroll type compressor, wherein the anti-rotation ring is provided in an anti-rotation mechanism for preventing a movable scroll from rotation on its own axis and made of a metal, the steps of the method include drawing a steel plate into a first intermediate body having a bottomed cylindrical shape, punching the bottom of the first intermediate body thereby to make a second intermediate body and ring forming the second intermediate body.

1 Claim, 6 Drawing Sheets

(51) Int. Cl.

| | |
|---|---|
| ***F04C 2/00*** | (2006.01) |
| ***F04C 18/00*** | (2006.01) |
| ***F04C 27/00*** | (2006.01) |
| ***F01C 17/06*** | (2006.01) |
| ***F04C 18/02*** | (2006.01) |
| *F04C 23/00* | (2006.01) |

(52) U.S. Cl.
CPC ..... *F04C 18/0215* (2013.01); *F04C 23/008* (2013.01); *F04C 2230/20* (2013.01); *F04C 2230/60* (2013.01); *Y10T 29/49236* (2015.01)

(58) Field of Classification Search
USPC ..... 418/55.1–55.6, 57; 464/102
See application file for complete search history.

(56) References Cited

U.S. PATENT DOCUMENTS

| | | | | |
|---|---|---|---|---|
| 7,214,043 | B2 * | 5/2007 | Tsukamoto ..... | F01C 17/066 418/55.3 |
| 2003/0066581 | A1 | 4/2003 | Gehringhoff et al. | |

FOREIGN PATENT DOCUMENTS

| | | | |
|---|---|---|---|
| JP | 62-199983 | A | 9/1987 |
| JP | 6-81780 | A | 3/1994 |
| JP | 07-151071 | A | 6/1995 |
| JP | 11-351145 | A | 12/1999 |
| JP | 2000-074049 | A | 3/2000 |
| JP | 2000-087962 | A | 3/2000 |
| JP | 2001071051 | A | 3/2001 |
| JP | 2007-98428 | A | 4/2007 |
| JP | 2010-69522 | A | 4/2010 |
| JP | 2011-127446 | A | 6/2011 |
| JP | 2012-26281 | A | 2/2012 |

OTHER PUBLICATIONS

Communication dated Feb. 3, 2016, issued by the State Intellectual Property Office of the P.R.C. In corresponding Chinese Application No. 201410256155.1.

Communication dated Dec. 2, 2015 from the German Patent and Trademark Office in counterpart application No. 102014211123.4.

* cited by examiner

METHOD FOR MANUFACTURING ANTI-ROTATION RING OF SCROLL TYPE COMPRESSOR AND ANTI-ROTATION MECHANISM OF THE SCROLL TYPE COMPRESSOR

BACKGROUND OF THE INVENTION

The present invention relates to a method for manufacturing an anti-rotation ring of a scroll type compressor and an anti-rotation mechanism of the scroll type compressor.

Generally, a scroll type compressor has in a housing thereof a fixed scroll including a base plate and a scroll wall formed on the base plate. A rotary shaft is rotatably supported by the housing through a bearing. The rotary shaft has at one end thereof that is adjacent to the fixed scroll an eccentric shaft in an offset relation to the axis of the rotary shaft. The eccentric shaft is rotatably connected to a movable scroll through a bush and a bearing. The movable scroll includes a base plate having a boss to which the eccentric shaft is connected and a scroll wall engaged with the scroll wall of the fixed scroll. An anti-rotation mechanism is provided between the rear side of the base plate of the movable scroll and the housing. The anti-rotation mechanism prevents the movable scroll from rotating on its own axis while allowing orbital movement of the movable scroll. Compression chambers are hermetically formed between the scroll wall of the fixed scroll and the scroll wall of the movable scroll and compression of fluid in the compression chambers are accomplished by the orbital movement of the movable scroll relative to the fixed scroll.

Japanese Patent Application Publication No. 7-151071 discloses an anti-rotation mechanism of a scroll type compressor. The anti-rotation mechanism of this Publication includes a sleeve inserted into a hole of a housing of the compressor and an anti-rotation pin that is press-fitted in a base plate of a movable scroll and in sliding contact with the inner peripheral surface of the sleeve. The scroll type compressor includes a plurality of the anti-rotation mechanisms. The anti-rotation pins moving in sliding contact with the inner peripheral surface of the respective sleeves keep the movable scroll from rotating on its axis while allowing orbital motion of the movable scroll.

Japanese Patent Application Publication No. 62-199983 discloses an anti-rotation mechanism of a scroll type compressor including a plate pin press-fitted in a plate member, a movable pin press-fitted in the base plate of the movable scroll plate and making an orbital motion around the plate pin and an annular ring enclosing one ends of the plate pin and the movable pin, respectively. The plate pin and the movable pin are in line contact with the inner peripheral surface of the annular ring and regulated by the annular ring. Therefore, the anti-rotation mechanism allows the movable scroll to make an orbital motion while inhibiting the rotation of the movable scroll on its axis.

The sleeve disclosed in Japanese Patent Application Publication No. 7-151071 and the annular ring disclosed in Japanese Patent Application Publication No. 62-199983 (such sleeve and annular ring being hereinafter referred to as the anti-rotation ring) are in sliding contact with the pin having a high rigidity. Therefore, the anti-rotation ring needs to be machined with high accuracy and have high wear resistance. Generally, an anti-rotation ring is made by machining a metal bar into a ring, heat treating the ring by quenching and tempering, and then finishing the ring by grinding. However, conventional method for manufacturing an anti-rotation ring has problems in that manufacturing cost is high and manufacturing time is long. Specifically, cutting a metal bar into sections with a specified length and then machining a cut section into a ring shape takes a lot of time and affects the material yield.

The present invention is directed to providing a method for manufacturing an anti-rotation ring of a scroll type compressor that reduces the manufacturing cost and shortens the manufacturing time and an anti-rotation mechanism of the scroll type compressor.

SUMMARY OF THE INVENTION

In accordance with an aspect of the present invention, in a method for manufacturing an anti-rotation ring of a scroll type compressor, wherein the anti-rotation ring is provided in an anti-rotation mechanism for preventing a movable scroll from rotation on its own axis and made of a metal, the steps of the method include drawing a steel plate into a first intermediate body having a bottomed cylindrical shape, punching the bottom of the first intermediate body thereby to make a second intermediate body and ring forming the second intermediate body.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

First Embodiment

Figure 1:
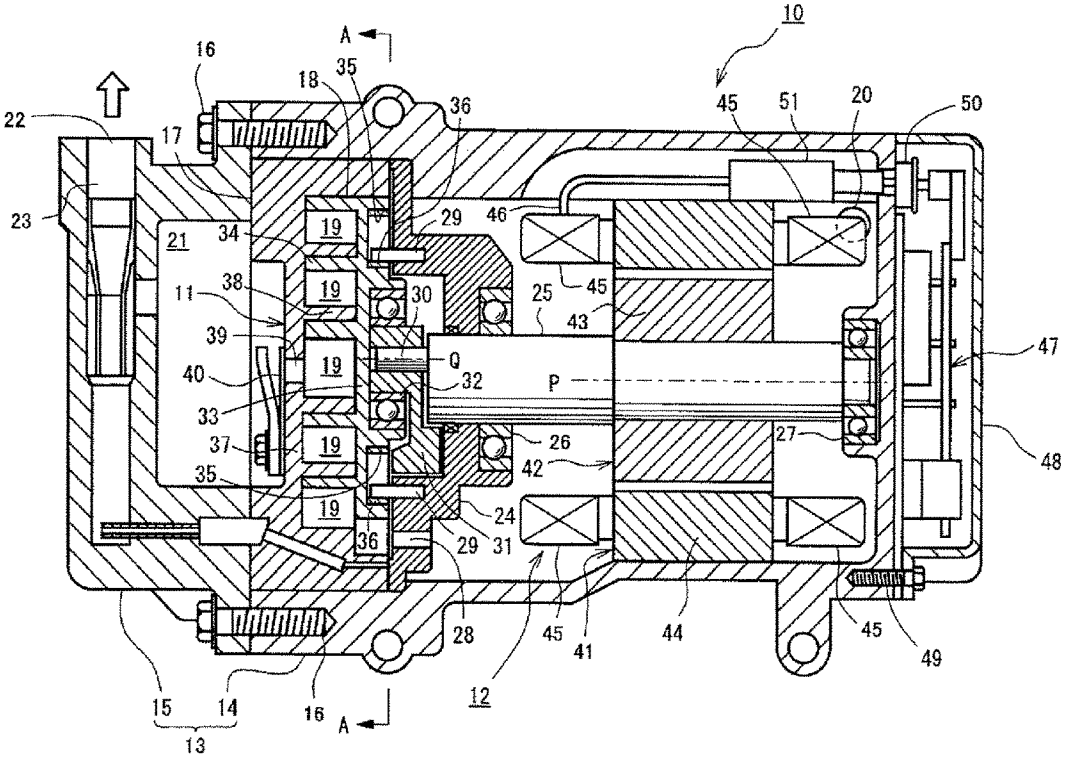
FIG. 1 is a longitudinal sectional view of a scroll type compressor according to a first embodiment of the present invention.

The following will describe a method for manufacturing an anti-rotation ring of a scroll type compressor according to the first embodiment of the present invention and an anti-rotation mechanism of the scroll type compressor while referring to the accompanied drawings. The scroll type compressor according to the present embodiment is a motor-driven scroll type compressor mounted on a hybrid vehicle having an internal combustion engine and an electric motor as drive sources. The scroll type compressor composes a part of a refrigerant circuit in a vehicle air-conditioner. Although not shown in the drawing, the vehicle air-conditioner further includes a cooling unit having a condenser, a receiver, an expansion valve, an evaporator and tubes interconnecting these devices.

Referring to FIG. 1, the scroll type compressor that is designated by numeral 10 integrally includes a compression mechanism 11 compressing refrigerant as fluid and an electric motor 12 for driving the compression mechanism 11. The scroll type compressor 10 has a housing 13 that is made of a metal. In the present embodiment, the housing 13 is made of an aluminum alloy. The housing 13 includes a first housing member 14 and a second housing member 15. The first housing member 14 and the second housing member 15 are fixedly connected at the ends thereof by bolts 16. Incidentally, the scroll type compressor 10 according to the present embodiment is mounted in a horizontal position in an engine room.

The first housing member 14 of the scroll type compressor 10 has therein the compression mechanism 11 and the electric motor 12. The compression mechanism 11 includes a fixed scroll 17 and a movable scroll 18. A plurality of compression chambers 19 are formed by and between the fixed scroll 17 and the movable scroll 18 in the compression mechanism 11. The fixed scroll 17 and the movable scroll 18 will be described later in detail. The first housing member 14 has therethrough in the upper part thereof an inlet port 20. The inlet port 20 is connected to an external refrigeration circuit (not shown in the drawing) for communication with the interior of the first housing member 14. During the operation of the scroll type compressor 10, low pressure refrigerant is flowed from the external refrigeration circuit into the first housing member 14 through the inlet port 20.

The second housing member 15 has therein a discharge chamber 21 that is communicable with one of the compression chambers 19. The second housing member 15 has in the upper part thereof an outlet port 22 for communication between the discharge chamber 21 and the external refrigeration circuit. The second housing member 15 has therein a passage 23 that provides fluid communication between the discharge chamber 21 and the outlet port 22.

A shaft support member 24 is provided in the first housing member 14 between the fixed scroll 17 and the electric motor 12. The shaft support member 24 composes a part of the compression mechanism 11 and has therein a bearing 26 that supports one end of a rotary shaft 25 of the electric motor 12. The other end of the rotary shaft 25 is supported by the first housing member 14 through a bearing 27. The shaft support member 24 has therethrough a suction port 28 that is in communication with two of the compression chambers 19. The refrigerant drawn into the first housing member 14 through the inlet port 20 is introduced through the suction port 28 into the compression chambers 19. The shaft support member 24 has fixed pins 29 press-filled in the shaft support member 24 and projecting toward the movable scroll 18.

An eccentric pin 30 is provided projecting from the end of the rotary shaft 25 adjacent to the fixed scroll 17 toward the fixed scroll 17. The axis Q of the eccentric pin 30 is positioned eccentrically with respect to the axis P of the rotary shaft 25, so that the eccentric pin 30 is eccentrically rotated with respect to the axis P of the rotary shaft 25 when the rotary shaft 25 rotates. A drive bush 31 is relatively rotatably mounted on the eccentric pin 30. The drive bush 31 has a balancing weight that balances the eccentric load of the eccentric pin 30 and the drive bush 31 developed by the rotation of the rotary shaft 25.

The movable scroll 18 is rotatably mounted on the outer peripheral surface of the drive bush 31 through a bearing 32, so that the movable scroll 18 can make an orbital motion. The movable scroll 18 includes a circular movable base plate 33 and a movable scroll wall 34. The movable scroll 18 is disposed such that the surface of the movable base plate 33 is positioned as a right angle with respect to the axis P. The movable scroll wall 34 is formed projecting from the surface of the movable base plate 33 on the side thereof that is adjacent to the fixed scroll 17. The movable scroll wall 34 has a wall surface parallel to the axis P.

Figure 2:
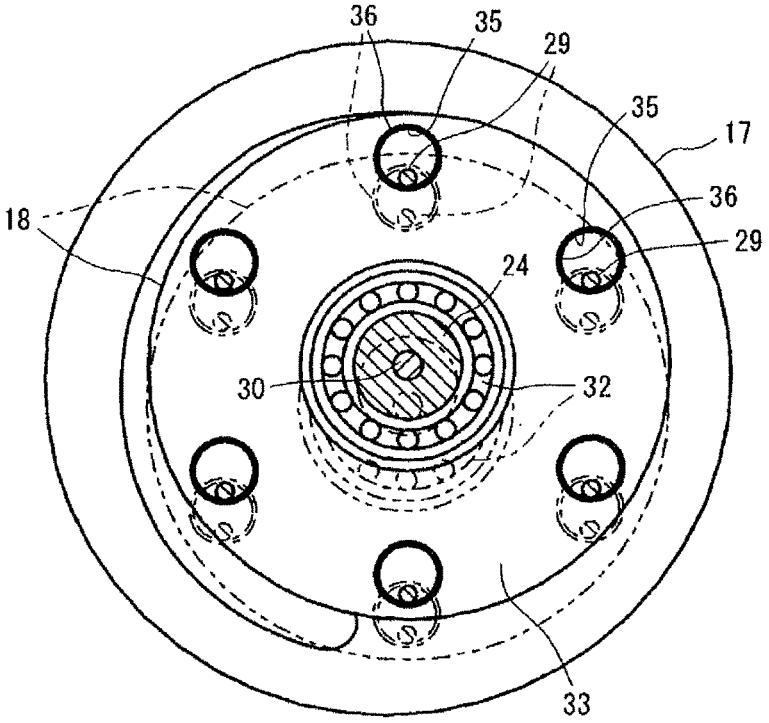
FIG. 2 is a transverse sectional view taken along the line A-A of FIG. 1.
Figure 3:
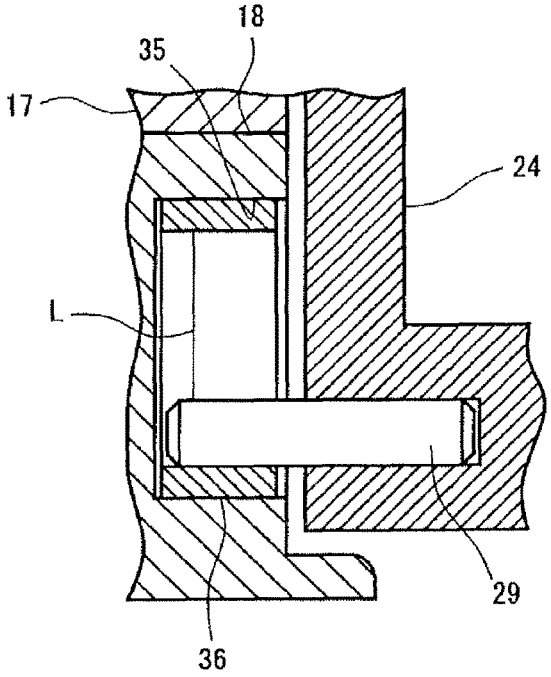
FIG. 3 is an enlarged longitudinal sectional view of an anti-rotation mechanism of the scroll type compressor of FIG. 1.

As shown in FIGS. 1, 2, a plurality of bottomed cylindrical holes 35 are formed at positions adjacent to the outer peripheral edge of the movable base plate 33. As shown in FIG. 3, a plurality of anti-rotation rings 36 (only one being shown) are inserted in the respective bottomed cylindrical holes 35 (only one being shown). Each anti-rotation ring 36 has a cylindrical shape and is rotatable in the bottomed cylindrical hole 35. A retainer (not shown in the drawing) is provided in the movable base plate 33 to keep the anti-rotation ring 36 in the bottomed cylindrical hole 35. The fixed pins 29 are located at a position in the shaft support member 24 that corresponds to the respective bottomed cylindrical holes 35. Each fixed pin 29 projects from the shaft support member 24 toward the bottomed cylindrical hole 35 and is inserted into the anti-rotation ring 36. The fixed pin 29 is disposed with its axis extending parallel to the axis P of the rotary shaft 25. In the present embodiment, the anti-rotation rings 36 and the fixed pins 29 form the anti-rotation mechanism for preventing the movable scroll 18 from rotating on its axis. Therefore, the movable scroll 18 orbits around the axis P without rotating on its axis when the rotary shaft 25 is rotated. That is, the movable scroll 18 is provided so as to perform an orbital movement around the axis P without rotation.

The fixed scroll 17 is engaged with the movable scroll 18 in facing relation to each other and fixed to the first housing member 14. The fixed scroll 17 has a circular fixed base plate 37 and a fixed scroll wall 38 that are integrally formed. The fixed base plate 37 is disposed in the first housing member 14 so as to close the end opening of the first housing member 14. The fixed scroll wall 38 is formed projecting from the surface of the fixed base plate 37 adjacent to the movable scroll 18.

In the scroll type compressor 10 according to the present embodiment, the compression chambers 19 are formed between the fixed scroll wall 38 and the movable scroll wall 34 by the contact engagement of the fixed scroll wall 38 of the fixed scroll 17 and the movable scroll wall 34 of the movable scroll 18. The refrigerant is drawn through the suction port 28 into the compression chambers 19 and compressed by the volume reduction of the compression chambers 19. The fixed scroll 17 has in the center thereof a discharge port 39 that is communicable with the discharge chamber 21 and is provided with a discharge valve 40 for opening and closing the discharge port 39. The compressed refrigerant is discharged through the discharge port 39 into the discharge chamber 21.

The electric motor 12 is a three-phase AC motor. The electric motor 12 includes a stator 41 and a rotor 42 which is inserted in the stator 41 and fixed on the rotary shaft 25. The rotor 42 has a rotor core 43 having therein a plurality of insertion slots (not shown in the drawing) in the axial direction of the rotary shaft 25 and permanent magnets (not shown in the drawing) inserted in the respective insertion slots (not shown in the drawing). The stator 41 has stator cores 44 fixed on the inner wall of the first housing member 14 and stator coils 45 wound on the respective stator cores 44 for U-phase, V-phase and W-phase. One end of the winding wire forming the stator coil 45 for each phase serves as a lead wire 46 receiving power supply.

The electric motor 12 is driven by power supply control of a drive circuit 47 provided outside of the first housing member 14. The drive circuit 47 has an inverter unit, various electrical parts and a circuit board mounting thereon the inverter unit and the parts. The inverter unit has switching devices, receives power supply from the outside of the scroll type compressor 10 and converts DC power to AC power for driving the scroll type compressor 10.

The scroll type compressor 10 includes a case 48 that is fixedly connected to the first housing member 14 for protecting the drive circuit 47. In the present embodiment, the drive circuit 47 and the case 48 are fixed to the first housing member 14 by a bolt 49. The first housing member 14 and the case 48 cooperate to form a sealed space in which the drive circuit 47 and an airtight terminal 50 that is electrically connected to the drive circuit 47 are arranged.

A cluster block 51 is provided in the first housing member 14. The airtight terminal 50 is electrically connected to the lead wire 46 coming from the stator coil 45 of each phase through the cluster block 51. Thus, the electric motor 12 and the drive circuit 47 are electrically connected. When the stator coils 45 of the electric motor 12 are supplied with AC power from the drive circuit 47 through the airtight terminal 50, the rotor 42 is rotated and the compression mechanism 11 connected to the rotary shaft 25 is operated.

The following will describe a method for manufacturing the anti-rotation ring 36 of the anti-rotation mechanism. The anti-rotation ring 36 according to the present embodiment is made according to a manufacturing process illustrated in FIG. 4. In the first step, a steel plate 36A is drawn into a first intermediate body 36B by press forming. Chromium-molybdenum steel (SCM415) is used as the material of the steel plate 36A according to the present embodiment.

Figure 5:
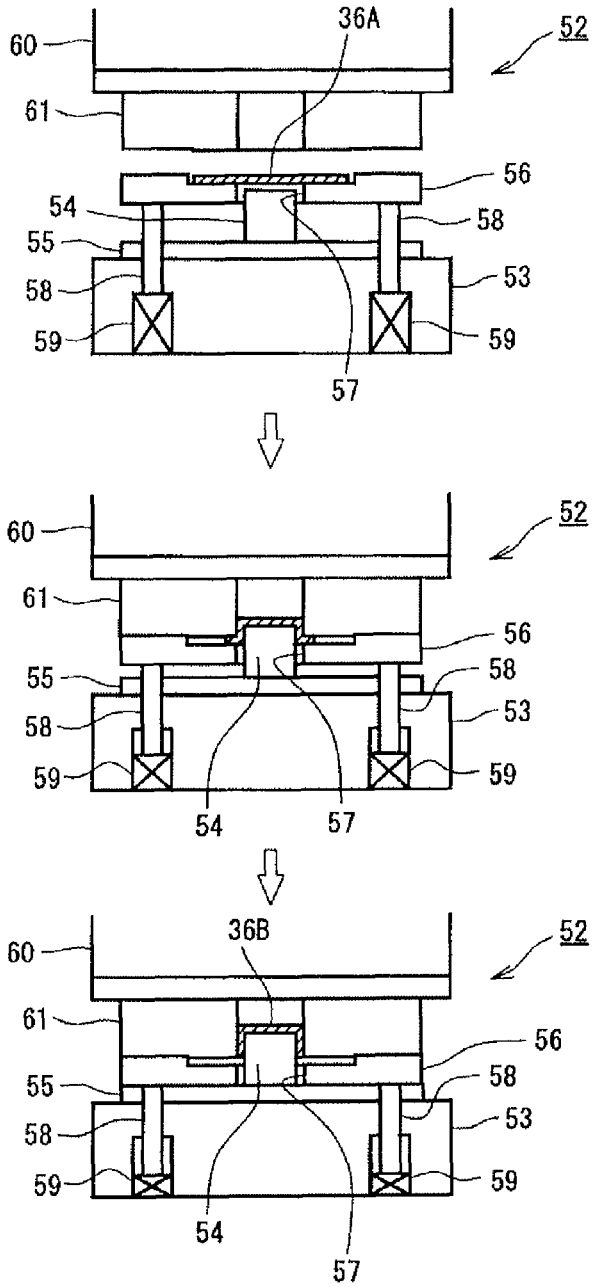
FIG. 5 is an explanatory diagram showing drawing steps by press in the manufacturing process in FIG. 4.

The drawing is performed by a press machine 52 shown in FIG. 5. A cylindrical punch 54 is mounted on a punch holder 55 that is provided on a base 53 of the press machine 52. A blank holder 56 is provided above the punch holder 55 for suppressing wrinkles formed on the steel plate 36A. The upper surface of the blank holder 56 serves as the mounting surface on which a blank or the steel plate 36A is placed. The blank holder 56 has therein a hole 57 through which the punch 54 may be inserted and is provided with guide members 58 for guiding the blank holder 56 to slide properly with respect to the base 53. The guide members 58 are connected to damper mechanisms 59 provided in the lower part of the base 53. The blank holder 56 is placed in the uppermost position when no downward force is applied to the blank holder 56. The damper mechanisms 59 serve to suppress rapid lowering of the blank holder 56. With the blank holder 56 lifted to the uppermost position, the upper surface of the blank holder 56 is positioned slightly higher than the upper surface of the punch 54. The press machine 52 has a vertically movable ram 60 that is provided above the blank holder 56 and equipped with a die 61. The die 61 has therein a die cavity whose diameter is lager than that of the punch 54 so that the punch 54 can be inserted in the die 61.

In drawing step, after the steel plate 36A is mounted on the upper surface of the blank holder 56, the ram 60 is lowered so that the die 61 is contacted with the steel plate 36A and further lowered thereby to push downward the blank holder 56 and the die 61 together so that the punch 54 is forced through the die cavity of the lowering die 61, as shown in FIG. 5. As a result, the steel plate 36A is plastically deformed by the punch 54 into the aforementioned first intermediate body 36B having a bottomed cylindrical shape. It is noted that in the above drawing step, the ram 60 is actuated repeatedly for a plurality of times for lowering operation for plastic deforming of the steel plate 36A into the first intermediate body 36B by pushing the punch 54.

Figure 4:
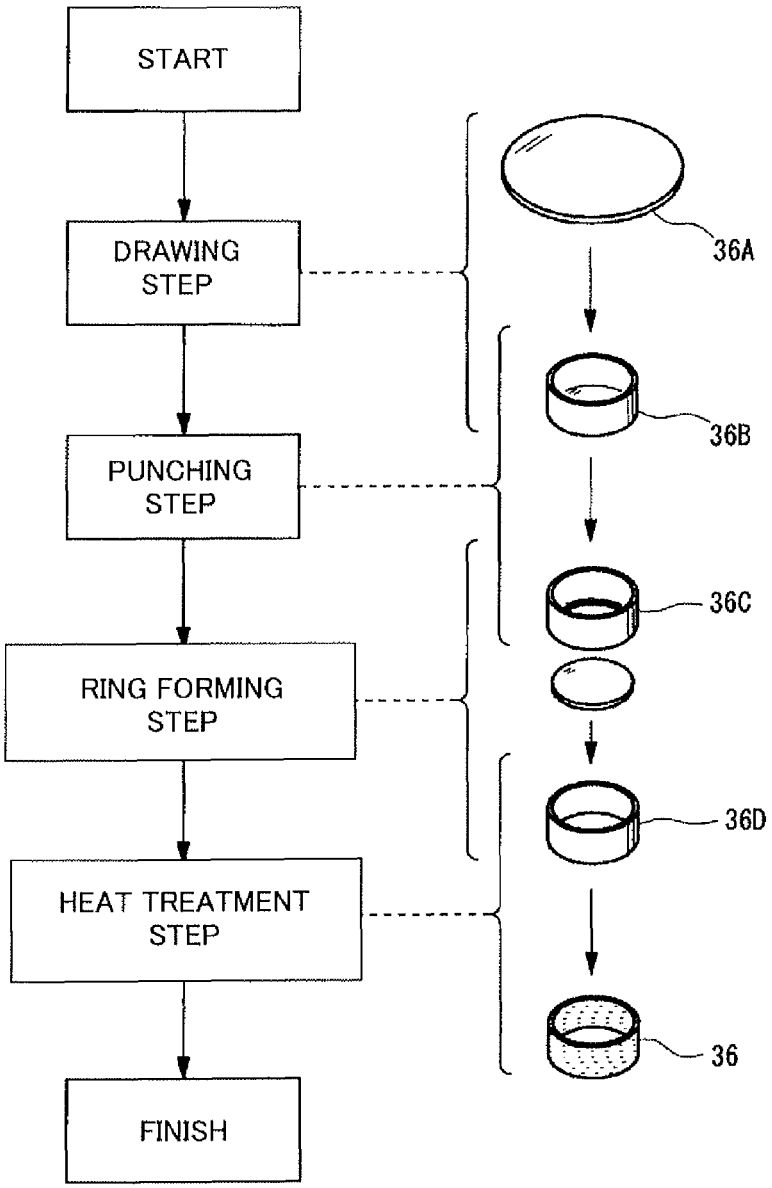
FIG. 4 is an explanatory diagram showing the manufacturing process of the anti-rotation ring of the scroll type compressor of FIG. 1.
Figure 6A:
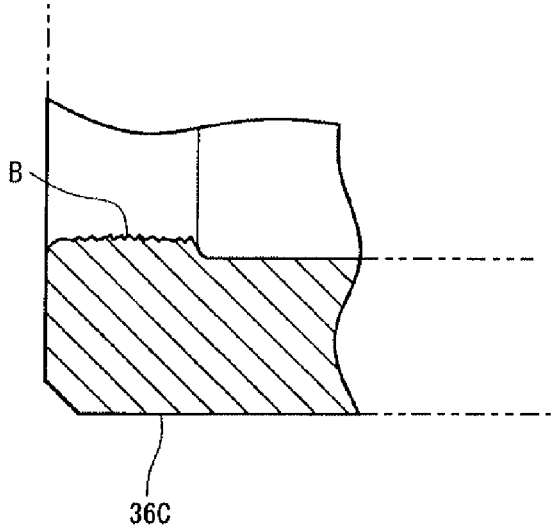
FIG. 6A is a partial longitudinal sectional view of a second intermediate body before ring forming and FIG. 6B is a partial longitudinal sectional view of a third intermediate body after ring forming.

In the punching step shown in FIG. 4, the bottom of the first intermediate body 36B is removed by punching to make a second intermediate body 36C having a bottomless cylindrical shape. The punching step is performed by using a punch (not shown in the drawing) mounted on the ram 60 of the press machine 52 of FIG. 5. The outer diameter of the punch is set slightly smaller than the inner diameter of the hole of the first intermediate body 36B. A holder (not shown in the drawing) is mounted on the base 53 of the press machine 52 for supporting the first intermediate body 36B. In the punching step, the bottom of the first intermediate body 36B is removed by the punch by lowering the ram 60 as in the case of the drawing process to make the second intermediate body 36C. Punching to remove the bottom of the first intermediate body 36B may be accomplished by actuating the press machine 52 to lower the ram 60 only once. As shown in FIG. 6A, burr B is formed by the punching in the inner peripheral surface adjacent to the punched end of the second intermediate body 36C.

In the ring forming step shown in FIG. 4, the second intermediate body 36C is formed into a finished ring shape. In the ring forming step, the burr B formed in the second intermediate body 36C by the punching is removed for surface finishing. Removal of the burr B is accomplished by using a ring forming die (not shown in the drawing). Specifically, the burr B is plastically deformed gradually by inserting a ring forming die through the second intermediate body 36C for a plurality of times. As a result of such ring forming operation, the part of the second intermediate body 36C from where the burr B has been removed is formed to have the same diameter as the inner peripheral surface of the second intermediate body 36C, with the result that a third intermediate body 36D is made.

Figure 6B:
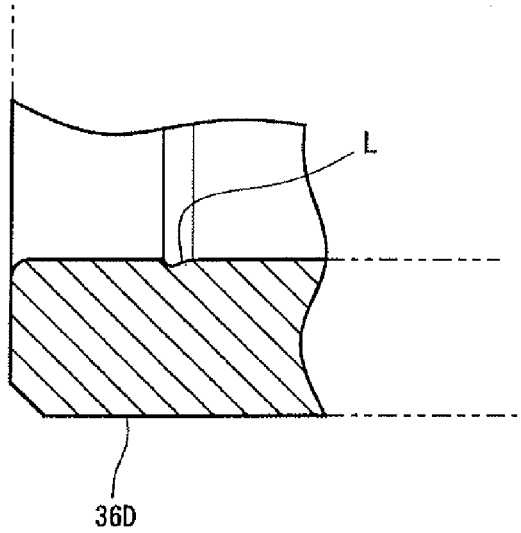

As shown in FIG. 6B, a small groove or a shock line L is formed in peripheral direction in the inner peripheral surface of the third intermediate body 36D made by the ring forming step. The shock line L is a groove that is not removed by ring forming step, but the shock line is formed at a position that is spaced from the punched end of the third intermediate body 36D for a distance corresponding to the thickness of the steel plate 36A. When the ring forming step is completed, the shape of the third intermediate body 36D is completely formed. Incidentally, the dimensional accuracy of the third intermediate body 36D is substantially the same as that of a conventional anti-rotation ring formed by machining.

In the present embodiment, the third intermediate body 36D made by the ring forming step is heat treated by soft nitriding. As shown in FIG. 4, the soft nitriding is a heat treatment using ammonia gas and carburizing gas for improving the fatigue resistance of the anti-rotation ring 36. The soft nitriding treatment is generally performed at a lower temperature as compared to quenching. Therefore, the deformation of an object due to the heat treatment by soft nitriding is relatively small. The third intermediate body 36D applied with the soft nitriding treatment is completed as the finished anti-rotation ring 36. The anti-rotation ring 36 is formed in the inner peripheral surface thereof with the shock line L.

The following will describe an anti-rotation mechanism having the anti-rotation ring 36 made according to the manufacturing process shown in FIG. 4 and the fixed pin 29. As a design condition, in the anti-rotation mechanism using the anti-rotation ring 36, the relative position between the anti-rotation ring 36 and the fixed pin 29 is set so that the shock line L does not affect the anti-rotation function. To fulfill this condition, the fixed pin 29 is inserted into the anti-rotation ring 36 to such an extent that the outer peripheral surface of the fixed pin 29 crosses over the shock line L. That is, the fixed pin 29 is set relative to the anti-rotation ring 36 so that no interference occurs between the end surface of the fixed pin 29 and the shock line L.

Specifically, with the fixed pin 29 positioned such that the outer peripheral surface of the fixed pin 29 crosses over the shock line L as shown in FIG. 3, the outer peripheral surface of the fixed pin 29 maintains proper sliding contact with the inner peripheral surface of the anti-rotation ring 36 in parallel relation to each other during the orbiting motion of the movable scroll 18. In the state shown in FIG. 3, therefore, the shock line L of the anti-rotation ring 36 does not affect anti-rotation function of the anti-rotation mechanism to prevent the movable scroll 18 from rotating.

The above-described embodiment offers the following advantageous effects.

(1) The first intermediate body 36B having a bottomed cylindrical shape is made by drawing a steel plate 36A by a press machine. The second intermediate body 36C of a cylindrical shape is made by punching the bottom of the first intermediate body 36B. The third intermediate body 36D is made by ring forming the second intermediate body 36C. The anti-rotation ring 36 is completed by soft nitriding the third intermediate body 36D. The method for manufacturing the anti-rotation ring 36 from the steel plate 36A can reduce manufacturing cost and time as compared to the method for manufacturing an anti-rotation ring by machining a metal bar.

(2) With the fixed pin 29 inserted in the anti-rotation ring 36 at a position where the outer peripheral surface of the fixed pin 29 crosses over the shock line L in the inner peripheral surface of the anti-rotation ring 36, the outer peripheral surface of the fixed pin 29 is in sliding contact with the inner peripheral surface of the anti-rotation ring 36 except the shock line L. Therefore, in spite of the presence of the shock line L in the inner peripheral surface of the anti-rotation ring 36, the inner peripheral surface of the anti-rotation ring 36 can maintain the parallelism with the outer peripheral surface of the fixed pin 29. Furthermore, the shock line L formed in the manufacturing process does not affect the function of the anti-rotation mechanism. Thus, the anti-rotation ring 36 made according to the manufacturing method including drawing process can be used.

(3) The anti-rotation ring 36 that is finished by soft nitriding as heat treatment can improve the surface hardness and abrasion characteristics necessary for sliding contact with the fixed pin 29. Since the heat treatment of the third intermediate body 36D is performed at a low temperature, distortion of the third intermediate body 36D by heat treatment can be suppressed and, therefore, additional process for removing the distortion by polishing or the like is dispensed with, with the result that the time for manufacturing the anti-rotation ring 36 can be reduced.

(4) Since the anti-rotation ring 36 is made according to the manufacturing method including drawing process, the material yield can be improved as compared to the method for manufacturing an anti-rotation ring by machining.

Second Embodiment

The following will describe an anti-rotation mechanism of a scroll type compressor according to the second embodiment of the present invention. The anti-rotation mechanism according to the second embodiment of the present invention is different from the first embodiment in that the anti-rotation mechanism according to the second embodiment includes a plurality of movable pins 72 press-fitted in the movable base plate 33 of the movable scroll 18 and projecting toward the shaft support member 24, as well as the fixed pins 29 and the anti-rotation rings 36. The reference numerals used in describing the first embodiment will be used to denote similar elements or parts of the second embodiment and the description thereof will be omitted.

Figure 7:
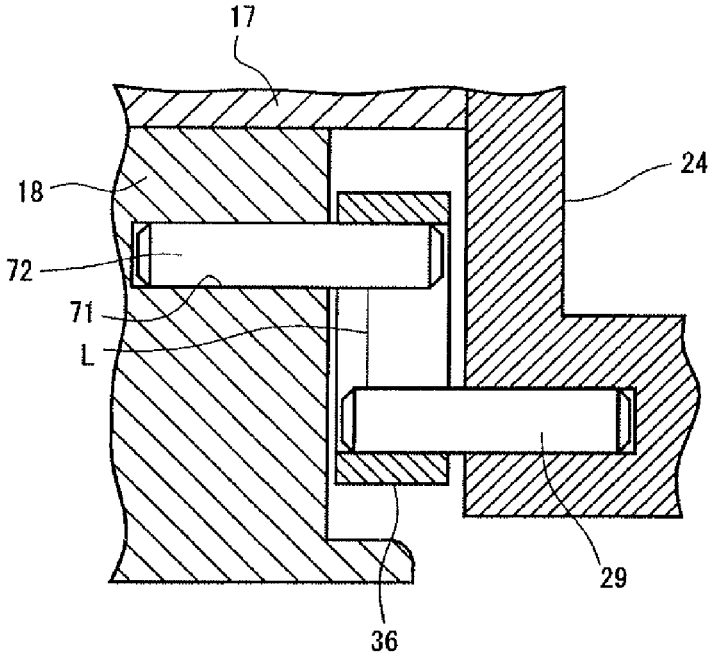
FIG. 7 is a partial longitudinal sectional view of an anti-rotation mechanism of a scroll type compressor according to a second embodiment of the present invention.

Referring to FIG. 7, a plurality of holes 71 are formed in the movable base plate 33 at positions adjacent to the peripheral edge of the movable base plate 33 (only one hole being shown in FIG. 7). The movable pins 72 are fixed in the respective hole 71 by press-fitting and project toward the shaft support member 24. The movable pins 72 and the fixed pins 29 are arranged with the axes thereof extending paralleled to each other. The anti-rotation rings 36 are disposed so as to cover the outer peripheries of the projecting ends of the movable pins 72 and the fixed pins 29, respectively. Each of the movable pins 72 and the fixed pins 29 corresponds to the pin according to the present invention that is in sliding contact with the inner peripheral surface of the corresponding anti-rotation ring 36.

The anti-rotation mechanisms according to the second embodiment of the present invention include the anti-rotation rings 36, the fixed pins 29 and the movable pins 72 and prevent the rotation of the movable scroll 18. Therefore, the movable scroll 18 orbits the axis P without rotating on its own axis.

As shown in FIG. 7, in the second embodiment of the present invention, the movable pin 72 is inserted into the anti-rotation ring 36 with the outer peripheral surface thereof crossing over the shock line L in the anti-rotation ring 36. That is, the position of the movable pin 72 in the inner peripheral surface of the anti-rotation ring 36 is set so that no interference occurs between the end of the movable pin 72 and the shock line L. Therefore, the movable pin 72 and the fixed pin 29 are inserted in the axial direction thereof with the outer peripheral surfaces of the movable pin 72 and the fixed pin 29 crossing over the shock line L in the anti-rotation ring 36.

In the second embodiment of the present invention, the fixed pin 29 and the movable pin 72 are inserted to a position in the anti-rotation ring 36 where the outer peripheral surfaces of the fixed pin 29 and the movable pin 72 cross over the shock line L in the anti-rotation ring 36. In such arrangement of the fixed pin 29 and the movable pin 72, the outer peripheral surfaces of the fixed pin 29 and the movable pin 72 are in sliding contact with the inner peripheral surface of the anti-rotation ring 36 except the shock line L. Therefore, in spite of the presence of the shock line L in the inner peripheral surface of the anti-rotation ring 36, the inner peripheral surface of the anti-rotation ring 36 can maintain the parallelism with the outer peripheral surfaces of the fixed pin 29 and the movable pin 72. Furthermore, the shock line L does not affect the function of the anti-rotation mechanism. Thus, the anti-rotation ring 36 of the second embodiment that is made according to the manufacturing process including drawing process can be used.

The present invention is not limited to the above-described embodiments, but it may be modified or embodied variously within the scope of the invention as exemplified below.

Although the steel plate for the anti-rotation ring 36 of the above-described embodiments is made of chromium-molybdenum steel (SCM415), the steel plate for the anti-rotation ring 36 may be made of any other chromium-molybdenum steel such as SCM435 or SCM414. Furthermore, the steel plate for the anti-rotation ring 36 may be made of a steel plate capable of being used for drawing such as cold rolled steel (SPCC), carbon steel (SC), or high carbon chromium bearing steel (SUJ2) other than chromium-molybdenum steel. Although the anti-rotation ring 36 of the above-described embodiments is applied with soft nitriding treatment as the heat treatment, the heat treatment is not limited to soft nitriding treatment. For example, nitriding treatment may be applied as the heat treatment. An object of heat treatment is to improve the surface hardness and the abrasion resistance of the anti-rotation ring 36. The third intermediate body 36D formed after ring forming step should preferably be applied with heat treatment that causes as little thermal stress as possible. Although the scroll type compressor of the above-described embodiments has six anti-rotation mechanisms, the number of the anti-rotation mechanisms provided in a scroll type compression should preferably be four or more.

What is claimed is:

1. An anti-rotation mechanism of a scroll type compressor comprising:

an anti-rotation ring having a cylindrical shape with both ends; and a pin having opposing end surfaces formed in an axial direction of the pin and inserted into the anti-rotation ring and in sliding contact with an inner peripheral surface of the anti-rotation ring, wherein a shock line is formed as a groove in a peripheral direction in the inner peripheral surface of the anti-rotation ring adjacent to one of the both ends in a manufacturing process, wherein the pin is inserted in the anti-rotation ring at a position where an outer peripheral surface of the pin crosses over the shock line in the inner peripheral surface of the anti-rotation ring.

* * * * *